United States Patent [19]

Warren

[11] Patent Number: 4,602,385

[45] Date of Patent: Jul. 29, 1986

[54] SHOCK ABSORBING, PUNCTURE RESISTANT AND THERMAL PROTECTIVE GARMENT

[76] Inventor: James C. Warren, 3808 S. Jasmine St., Denver, Colo. 80237

[21] Appl. No.: 519,547

[22] Filed: Aug. 2, 1983

[51] Int. Cl.[4] ..... A41D 13/00

[52] U.S. Cl. ..... 2/2; 2/2.5; 2/410; 2/84; 2/92

[58] Field of Search ..... 2/2, 2.5, 92, 84, 5, 2/410, 243 R; 428/902, 911

[56] References Cited

U.S. PATENT DOCUMENTS

| | | | |
|---|---|---|---|
| 2,971,198 | 2/1961 | Tomich | 2/84 |
| 3,440,660 | 4/1969 | Krinke | 2/410 |
| 3,577,305 | 5/1971 | Hines et al. | 2/243 R |
| 3,813,281 | 5/1974 | Burgess et al. | 2/2.5 |
| 3,973,275 | 8/1976 | Blauer | 2/2.5 |
| 4,100,620 | 7/1978 | Pecoraro | 2/2 |

FOREIGN PATENT DOCUMENTS

| | | | |
|---|---|---|---|
| 1129431 | 5/1962 | Fed. Rep. of Germany | 2/2 |

OTHER PUBLICATIONS

Marjory L. Joseph, "Introductory Textile Science", copyright 1981 by CBS College Publishing, pp. 102–104.

*Primary Examiner*—Werner H. Schroeder
*Assistant Examiner*—J. Kravitz

[57] ABSTRACT

A protective vest is disclosed having a body portion wrappable and securable about a torso of a wearer and a head portion hingeably connected thereto for securing about the head of the wearer. The body and head portions both include respective quick connection means for easy entry into the vest prior to an aircraft crash. A multiple layer laminate material forms the head and body portions and gives thermal, puncture and shock absorption protection. The entire vest can be folded and stored within the head portion in a compact pack.

6 Claims, 11 Drawing Figures

SHOCK ABSORBING, PUNCTURE RESISTANT AND THERMAL PROTECTIVE GARMENT

BACKGROUND OF THE INVENTION

1. Field of the Invention

The present invention relates to protective garments and, more particularly, to protective garments that have shock absorbing, puncture resistant, and thermal protection characteristics associated therewith.

2. Description of the Prior Art

As will be described in detail, the present invention will be seen to define a garment or vest for use, such as, by persons occupying the cabin of an airplane. Such a garment, with its objects of providing shock absorption, puncture resistance, and thermal protection for the wearer, has been unavailable heretofore. Though this description will be directed primarily to airplane crash applications, other protective uses of the garment will be apparent to those of skill in the art.

The prior art is virtually devoid of any reference to airplane crash protective equipment. A compact headgear having laminated layers separated by shock protective material like styrofoam or cork as seen in A. J. Krinke, U.S. Pat. No. 3,440,660. Krinke is indicated as being applicable to usage in association with an airplane. Krinke does not protect the torso of the wearer nor does Krinke address problems associated with fire or thermal protection.

The need for a protective garment for use in general aviation aircraft can be understood by a review of the problems associated with a light aircraft crash. The cabin structures of general aviation aircraft are constructed to withstand, intact, impacts associated with accelerations of between ten and forty gravities, or g's. In light aircraft, severe but nonfatal injuries are common when only three to five g's are encountered by the occupants of a cabin. Fatalities and/or very severe injuries are a result of any crash decelerations of between six and ten g's. The foregoing statistics are in light of the fact that almost all the occupants of the aircraft wore seatbelts.

Analysis of the type of injury indicates two main areas of the human body, the head and the chest, are particularly susceptible to aircraft induced injuries. Approximately forty percent aircraft induced injuries are cranial-facial, while between fourteen and twenty percent of all fatalities are directly due to head injuries. An even larger percentage, seventy percent, of general aviation accidents involving fatality are a result of skull fractures, often in conjunction with other injuries. Crushing of the chest cavity is also a common injury.

Skull fractures do not typically occur until a peak acceleration of five hundred g's is reached. The brain can avoid damage by way of a concussion as long as impacts are limited to less then fifty g's. It is apparent that the risk of severe injury can be lessened by lowering the g forces associated with impact.

Besides impact related injuries, one of every three otherwise survivable aircraft accidents ends in a fatality because of fire and flash or toxic fumes. Exposure of fifty percent of the skin area of a human being to a surface temperature of a 180° F. or above results in fatalities fifty percent of the time. Protection against this temperature can substantially increase the chance of survival.

Parachutes are not standard in general aviation. Though their place in sport activities and military applications is undoubtedly secure, parachutes have played an insignificant role in protecting persons in light general aviation aircraft from the possibility of crash landing. This is due in large part because general aviation aircraft can, in the case of an engine failure and many other mechanical failures, glide for some distance to a crash landing. In commercial jet applications, the speed, altitude and number of people involved are simply too complex a problem to consider an ejection or parachute type system.

In relation to nonaircraft applications, very little in the way of protective garments are available. L. L. Irvin, U.S. Pat. No. 2,375,655 shows survival type clothing adapted for use after a forced landing has occurred in hostile conditions. The clothing or garment is compact and is adapted to be embodied in a parachute pack.

Shock resistant sport clothing is seen in P. Rolando U.S. Pat. No. 4,195,362 which primarily relates to activities such as skiing. The body and sleeve of the garment in Rolando are of layered construction including an outer windproof layer of filled nylon or cotton, an intermediate layer of highly insulated foam material such as polyurethane and an inner layer of elastic nylon fabric. No hood or other protection is provided for the head.

The patents to L. E. Burgess, U.S. Pat. No. 3,813,281, and W. J. Collins, U.S. Pat. No. 2,771,384 both show layered material for use as a protective armor. Neither Burgess nor Collins show any protection for the head. Burgess shows plural layers of rigid platelets separated by a compressible foam layer, preferably high density polyurethane. Collins glues layers of material together in such a manner to form pockets, the outer layers of such pockets carrying rigid platelets.

Fire resistant or thermal protective clothing or garments are seen in the patents to R. E. Sullivan, U.S. Pat. No. 2,683,876, and R. Coolbaugh, U.S. Pat. No. 3,096,759. Sullivan discloses and shows a blanket formed of flameproof material. A hood or head portion formed of two laminated panels protects the head. The hood can be pulled down to mitigate fumes and provide some filtration of fouled air, as well as protect the head and face from heat and flame. Coolbaugh is used for caring for injured persons. It includes the material "Kay-cel" which is fire resistant.

Multiple layered clothing including a protective hood is seen in the patents to M. Bell, U.S. Pat. No. 4,338,686, and A. Grenier, U.S. Pat. No. 3,706,102. Both Bell and Grenier are directed toward ventilated and insulated garments and utilize multiple layered constructions to achieve that result. In a similar vein is the patent to J. Datlof, U.S. Pat. No. 2,831,198.

Of general interest as they relate to multilayered garments are the welder's jacket of D. La Marre, U.S. Pat. No. 3,691,564 and A. and M. Vagas, U.S. Pat. No. 1,077,177 for a storm coat. Vagas does include protective headgear. Vagas is concerned with protecting the user from severe weather, rather than impact, puncture, shock, fire or heat.

OBJECTS AND SUMMARY OF INVENTION

It is the principal object of the present invention to provide a protective garment for use by a person.

It is a related object of the invention to provide a protective garment for use by a person during an aircraft crash that can be quickly donned by the user.

It is a further related object of the invention to provide a protective garment for use by a person that has shock absorption features.

It is a still further related object of the present invention to provide a protective garment for use by a person that is resistant to fire and heat.

It is another related object of the present invention to provide a protective garment for use by a person that is puncture resistant.

It is another object of the present invention to provide a laminated material from which a protective garment resistant to impact, shock, puncture, fire and heat is constructed.

In accordance with the objects of the invention, a vest or garment is constructed of a laminated material which has thermal protective, shock absorption, and puncture resistant properties. The garment includes a body portion that is quickly connectable about the torso of the user, with front and back panels that are hingeably connected together along a top edge thereof. Respective side edges of the front and back panels are quickly connectable to secure about the torso of a human being.

A hood or head portion of the garment is hingeably connected to the back panel of the body portion and is securable over the head of the human user. The head portion includes a head panel extending from the connection to the back panel of the body portion to just above the eyes of the user. Two side panels are connected to the head panel. A face panel is integrally connected to one of the side panels and has quick connection means for securement to the other of said side panels.

The laminated fabric includes, as used in the front panel of the body portion and the hood, an outer layer and backing layer for thermal protection, fire resistance, and puncture resistance. An intermediate layer includes a double layer of shock absorption material. A lightweight inner layer is provided. Together, the laminate has been found to exhibit excellent performance characteristics in shock absorption, thermal protection, and puncture resistance.

DESCRIPTION OF THE PREFERRED EMBODIMENT

Figure 1:
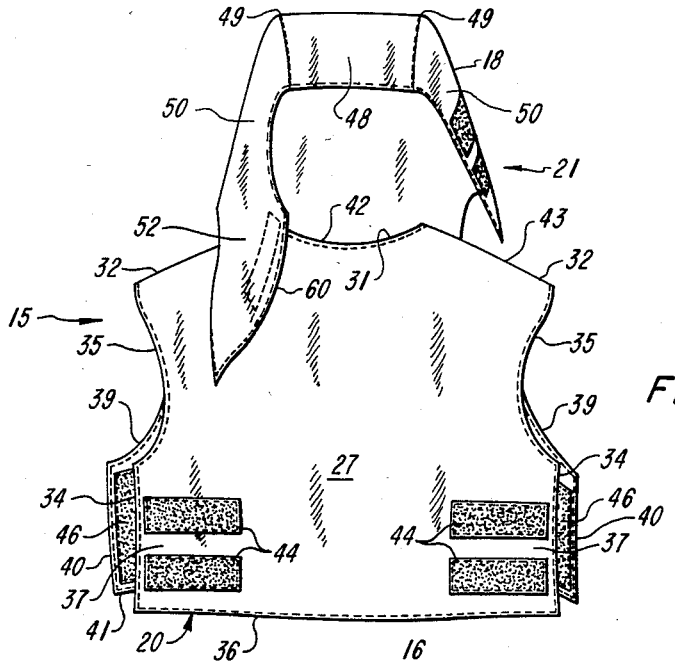
FIG. 1 is a front view of the protective vest of the present invention, with the body portion and hood portion being shown in an unconnected position.

A protective vest or garment 15 for use, for example, in an aircraft, is seen in FIGS. 1 through 4 to include a body portion 16 and a hood or head portion 18 hingeably connected thereto. Though this description relates primarily to use of the vest 15 in an aircraft crash, other uses of the protective garment are available. The vest 15 is easily foldable into a compact storage pack 19 (FIG. 11) and has first quick connection means 20 associated with said body portion 16 and second quick connection means 21 associated with the head portion 18 so that the entire vest 15 can be donned by the user or wearer in a minimum amount of time.

The body portion 16 secures snugly about a torso of the human user providing thermal protection, puncture resistance, and shock absorption to the chest area, for example from conditions resulting from an aircraft crash. The head portion 18 overlaps and conforms to the body portion 16, providing some neck support, and defining only an eye opening 23 (FIG. 2) that is not protected.

Figure 5:
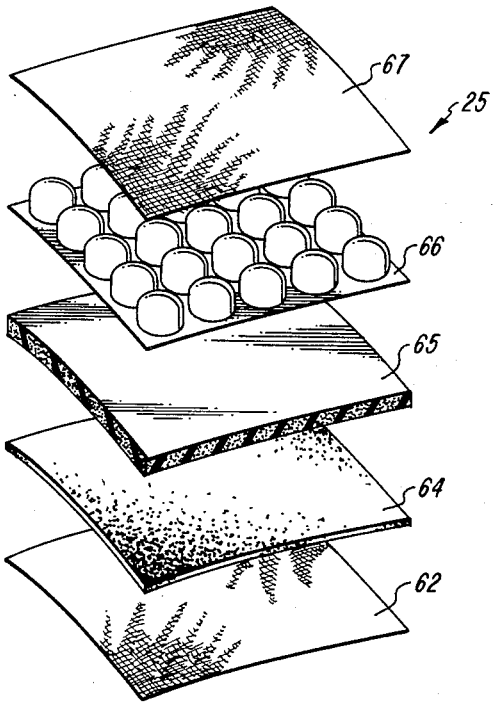
FIG. 5 is an enlarged exploded perspective view of a laminate material utilized in a front panel of the body portion and in the hood of the protective vest shown in FIG. 1.
Figure 6:
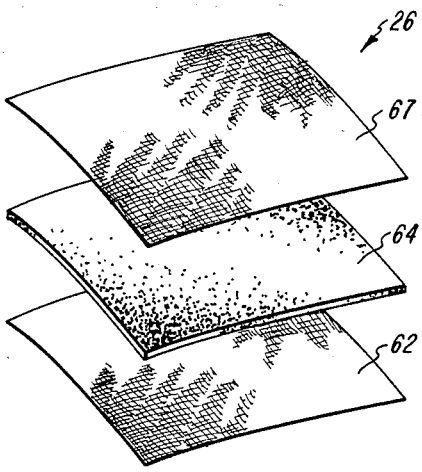
FIG. 6 is an enlarged exploded perspective view of a laminate material used in a back panel of the body portion of the invention shown in FIG. 1.

Two types of laminate material 25 and 26 (FIGS. 5 and 6) are used in the vest 15. The front laminate material 25 (FIG. 5) covers a front panel 27 of the body portion 16 of the vest 15 and the entire head portion 18. A rear laminate material 26 (FIG. 6) is used on a back panel 28 (FIG. 4) of the body portion 16. Both the front and back laminate materials 25 and 26, respectively, provide thermal protection for the wearer. The front laminate material 25 includes a double shock absorption layer 30 not present in the back laminate material 26 providing increased shock absorption and impact protection. As has been discussed in some detail in the Background of the Invention, reduction of the g forces encountered by passengers and pilots in aircraft crashes can significantly reduce the seriousness of injuries and fatalities encountered in such crashes.

The body portion 16 (FIG. 1) includes the front panel 27, adapted to lie adjacent to the chest of the wearer of the vest 15, and the back panel 28 corresponding to the back of such a wearer. The front panel 27 and back panel 28 are virtually identical in shape.

As seen in FIG. 1, the front panel 27 is of generally rectangular shape. The front panel 27 includes an arcuate head cutout 31 and a pair of top edges 32 descending slightly downwardly from an outer termination of the cutout 31. The top edges 32 terminate at arcuate arm cutouts 35. Side edges 34 extend downwardly from each arm cutout 35. A bottom edge 36 extends between the two side edges 34 and corresponds roughly to the belt line of a wearer when the vest 15 is donned. A flap 37 is defined between the arm cutouts 35, side edges 34 and bottom edge 36, to which flap 37 the first connection means 20 is secured, as will be described hereinafter. The front laminate material 25 is sewed around the top edge 32, arm cutouts 35, side edge 34, bottom edge 36 and head cutout 31 to form the front panel 27.

The back panel 28 is constructed from back laminate material 26. The back panel 28 includes top edges 38, arm cutouts 39, two side edges 40, a bottom edge 41 and a head cutout 42. The flaps 37 of the back panel 28 are located between the side edges 40 and bottom edge 41. The front panel 27 is connected to the back panel 28, along their respective top edges 32 and 38, by sewing or another suitable connection process to define a hinge or connection seam 43.

Figure 2:
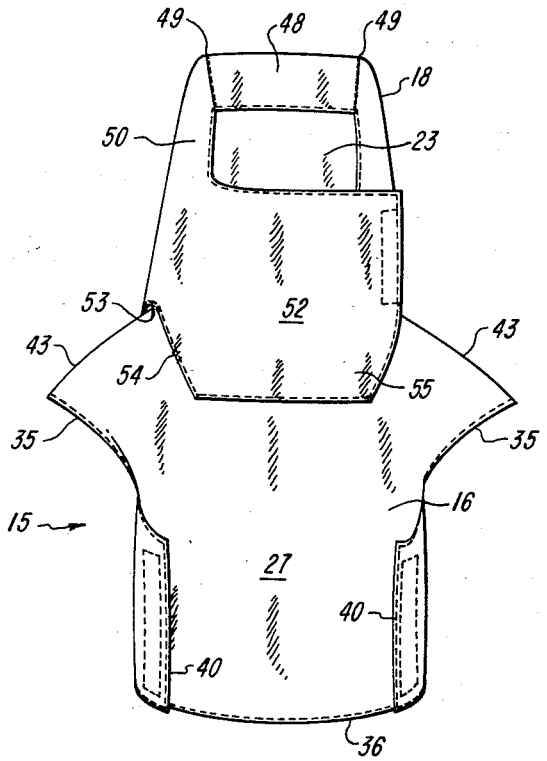
FIG. 2 is a view similar to FIG. 1 with the body and hood portions being shown connected.
Figure 3:
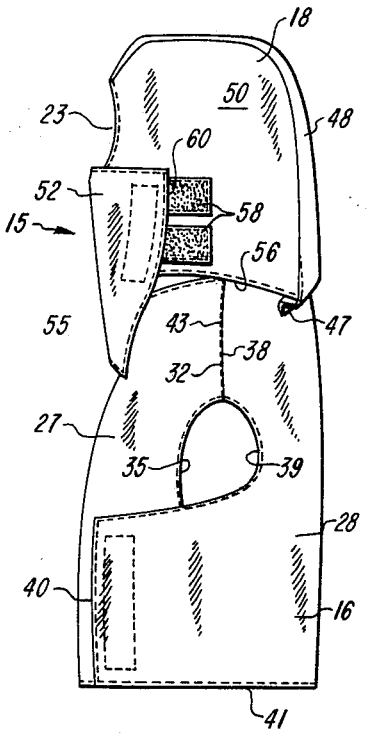
FIG. 3 is a side elevational view of the invention shown in FIG. 2.
Figure 4:
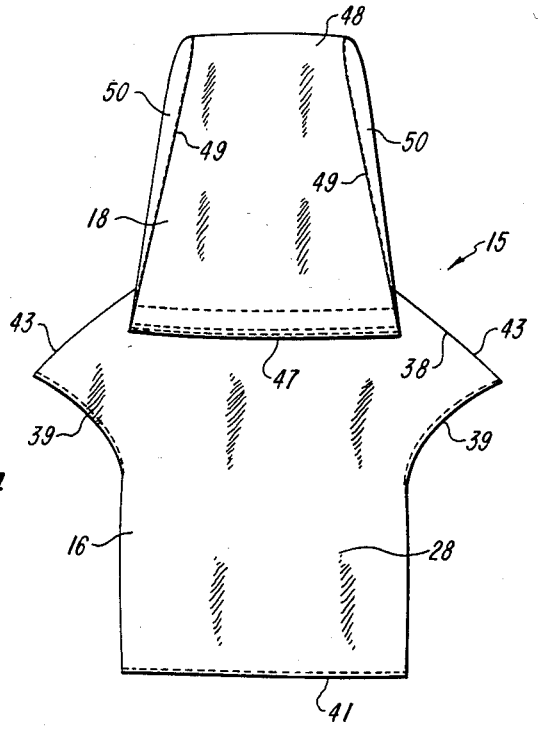
FIG. 4 is a rear view of the invention shown in FIG. 2.

The front panel 27 and back panel 28 also include the quick connection means 20. In the preferred embodiment, the front panel 27 includes at each flap 37 a pair of Velcro hook and loop type connection pads 44 of an elongated rectangular configuration extending in a horizontal superimposed parallel relationship above the bottom edge 36 of the outer surface of the front panel 27 from each side edge 34. The quick connection means 20 also includes a third hook and loop type connection pad 46 oriented vertically along and adjacent to the flap 37 of the inner surface of the back panel 28. As seen in FIGS. 2 and 3, the flaps 37 of the front panel 27 are wrapped around the torso of the wearer and the side edges 40 of the back panel are overlaid thereon to connect the pads 44 to the pad 46. This is done on both side edges 34 of the body portion 16 in a very rapid manner. The elongated orientation of the horizontal pads 44 of the front panel 27 provides for a mate with the vertically oriented pads 46 at a plurality of locations along the length of the pads 44. Adjustment to several sizes of torso is therefore incorporated into the vest 15.

The head portion 18 is extremely important to the overall effectiveness of the vest 15 in achieving its object of shock absorption. The head of a wearer is particularly susceptible to injury as a result of impact alone.

The head portion 18 therefore includes a hinge connection 47 at which a head panel 48 is connected to the back panel 28 of the body portion 16 near the head cutout 42. This hinge connection 47 allows the head portion 18 to be folded relative to the body portion 16 and facilitates storage of the vest 15 into the pack 19, as will be described later and as is seen in FIGS. 7 through 11. The head panel 48 extends upwardly over the top of the head and downwardly to cover a portion of the forehead of a wearer of the vest 15. A pair of hood seams 49 connect edges of the head panel 48 to a pair of side panels 50 which extend forwardly from the hinge connection 47 over the seam 43 of the body portion 16 to a position generally near the mouth of the wearer.

One of the side panels 50 includes an integrally formed face panel 52. An arcuate shoulder cutout 53 is formed along bottom edges 54 of the side panels 50 to generally conform to and pass over the shoulders of a wearer of the vest 15 at the seams 43 of the body portion 16. The face panel 52 includes an integral neck protector 55 that, when the face panel 52 is connected across the face of the wearer, as will be described shortly, extends a relatively short distance down over the chest of the wearer and the front panel 27 of the body portion 16. When the face panel 52 is connected to the opposite side panel 50 by the second quick connection means 21, a second shoulder cutout 56 of side panel 50 passes over the shoulder of the wearer at the seam 43 of the body portion 16 in a manner similar to that of the shoulder cutout 53 (FIG. 3).

The neck protector 55 and the substantially mating fit of the head portion 18 over the body portion 16 at the shoulder of the wearer gives additional support to the neck of the wearer during impact. As seen in FIG. 3, once the face panel 52 is connected to the opposite side panel 50, the bottom edge of the neck protector 55 rests on the front panel 27 of the body portion 16 and the shoulder cutouts 53 and 56 of the head portion 18 generally conform to the body portion 16 near the top edge seam 43 in a manner so as to resist forward and backward movement of the head relative to the torso of the wearer. Side movement of the head is also seen to be inhibited by securing the face panel 52 to the side panel 50.

The second quick connection means 21 of the face panel 52 to the side panel 50 are of similar construction to the first connection means 20 already described with reference to the body portion 16. A pair of hook and loop type connection pads 58 extend horizontally along the outer surface of the side panel 50, which does not include the face panel 52, in a superimposed parallel orientation generally adjacent to the shoulder cutout 56. A second hook and loop type connection pad 59 is joined along the inner surface of an outermost edge 60 of the face panel 52 and is generally vertically oriented with reference to the first two pads 58. Depending upon the location of the second pad 59 along the length of the first two pads 58, the face panel 52 can be tightened sufficiently to provide support, as well as fit and protection, to the head of the wearer.

It is seen in FIG. 2 that once the vest is donned, the chest and head area of the wearer are virtually completely covered. The eye opening 23 remains so that the wearer can see his way to safety. The head is substantially enclosed and some air is retained therein that protects the wearer from toxic fumes that may be present subsequent to an aircraft crash.

The front and back laminate materials 25 and 26 (FIGS. 5 and 6) assist the construction of the vest 15 as already described in accomplishing the objects of the invention. The front panel laminate material 25 (FIG. 5) is seen to include five distinct layers. Sewing the front panel 27 of the body portion 16 and the head 48, side 50 and face panels 52 of the head portion 18 together around the outer periphery thereof will be seen to hold the layers in adjacent relationship to each other without the need for gluing, heat bonding or the like.

The outer layer 62 of the front panel has extremely good resistance to fire, puncture and heat. This outer layer thereby is seen to initially resist heat and/or fire that may be encountered subsequent to a crash. The outer layer 62 is preferably formed of fabric made under the trademark "Kevlar", Style 740, manufactured by the Du Pont Co. This fabric has a weight per unit area of two ounces per square yard. The outer layer has a tear strength measured by American Standard Test Method (ASTM) D751 of 70.2 pounds. Puncture resistance measured by Federal Test Method (FTM) 2031 is 91.3 pounds. A flame ignition test in accordance with ASTM D1230 will not ignite "Kevlar".

The front laminate material 25 further includes a puncture resistant felt backing layer 64 adjacent to the outer layer 62. The backing layer 64 is preferably made of polyester felt having a heat-glazed side positioned adjacent to the outer layer 62. The polyester felt preferably has a weight per unit area of twelve ounces per square yard. Such a material is manufactured by Troy Mills, in New Hampshire. The puncture strength is 247 pounds and the time to ignition is six seconds, both measured under the standard test methods previously discussed.

Disposed immediately inwardly of the layer 62 is the double shock absorption layer 30 including a plastic foam layer 65 and an air bubble layer 66. These two layers are primarily directed to shock absorption. Due to the fact that both of these layers are composed to a great extent of air, and all layers of the front laminate material 25 are separated by air, insulation and buoyancy are provided to the wearer of the vest 15.

The foam layer 65 is preferably polyethylene foam sold under the trademark "Ethafoam" having a weight per unit area of six ounces per square yard and a thickness of approximately a quarter inch. "Ethafoam" is manufactured by the Dow Chemical Co. The foam layer 65 takes five seconds to ignition under ASTM D1230. A nonstandard compression test was conducted on the material. Samples were compressed up to a pressure of twenty pounds per square inch and the deflection measured. The energy absorbed was found to be 0.7 to 1.0 inch-pounds per square inch. The air bubble layer 66 is preferably a material sold under the trademark "Air Cap", manufactured by Sealed Air Corporation in Connecticut, having an energy absorption of 0.7 to 1.0 inch-pounds per square inch. "Air Cap" is a heavy duty, Saran coated polyethylene air bubble cushioning. Air bubbles of the air bubble layer are oriented to protrude toward an innermost layer 67.

The innermost layer 67 is puncture and tear resistant and is preferably formed of Ripstop nylon. The innermost layer 67 preferably is lightweight, having a 1.9 ounce per square yard weight to area ratio and is of a self-extinguishing type manufactured by Howe & Bainbridge, of Maine. The tear strength is 10.8 pounds. The puncture resistance as measured by FTM S2031 is 73.3 pounds. The time to ignition, as measured in accordance with ASTM D1230, is three seconds.

The back panel laminate material 26 includes the outer layer 62, backing layer 64 and innermost layer 67 materials. The outer, backing and inner layers 62, 64 and 67 are of identical material to the outer, backing and inner layers of the front laminate material 25. Thermal protection and puncture resistance is still provided by the laminate material 26 which, as was the case in the front laminate material 25, is held together by sewn seams around its perimeter.

The thermal protection provided by the front laminate material 25 of the vest 15 has been tested. The tests were conducted in accordance with ASTM E648-78, for measuring the heat flux in a floor covering system. A radiant mesh natural gas heat source operating at 1238° F. and an angle of thirty degrees relative to to horizontal is positioned at fourteen centimeters above the bottom edge of the laminate material 25 at the most proximate end of the heat source. In a first measured temperature position twenty-nine and one-half inches from the bottom edge of the laminate, it took an elapsed time of fifteen minutes for the innermost layer 67 of the front laminate material 25 to reach 160° F. After fifteen minutes had elapsed the temperature of the outer layer 62 had reached 240° F.

In a second position, twenty-five and one-half inches from the laminate 25, 4.8 minutes elapsed before the inner layer 67 reached 160° F. By the time the inner layer had reached 160° F., the outer layer 62 had reached a temperature of 273° F. It is apparent from these tests that protection to the wearer of the vest 15 from temperatures greater than 160° F. can be obtained for several minutes. In the background portion it was noted that if the torso and head, representing approximately fifty percent of the skin area of a wearer, experiences a surface temperature of 180 degrees F. or above, fatality results in fifty percent of the cases. Several minutes protection from such temperatures, as is seen to be provided by the present laminate material 25, significantly increases the chances that such thermal conditions will be survived.

Impact protection from the front laminate material 25 has been tested in accordance with Federal Motor Vehicle Safety Standard No. 218 relating to motorcycle helmet testing. A free falling magnesium simulated human head form of size seven and a quarter weighing eleven pounds and equipped with a traveling acceleration transducer at the center of gravity was tested with and without the front laminate material 25. The head form was allowed to impact on an elastomeric pad having a hardness of 60 A durometer. Deceleration was measured in terms of g forces. In conducting the test, the laminate 25 was placed on the elastomeric pad and impacted by the forehead of the head form.

The measured g forces for the impact without the laminate was 59 g's. When the front laminate material 25 was placed over the elastomeric pad and the test repeated, the g force was reduced to 42.4 g's. The percent reduction of impact was thereby measured to be 28 percent. By way of comparison, a downfilled ski jacket was used as a control for the same test. The ski jacket reduced the g forces ten percent.

Figure 8:
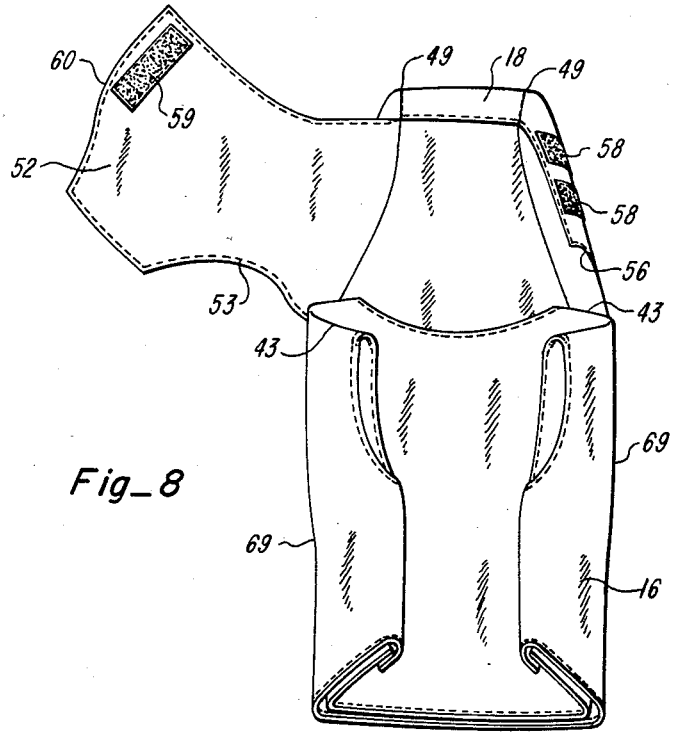
FIGS. 7 through 11 are sequential views showing the manner in which the invention as shown in FIG. 1 is folded into a compact package.
Figure 7:
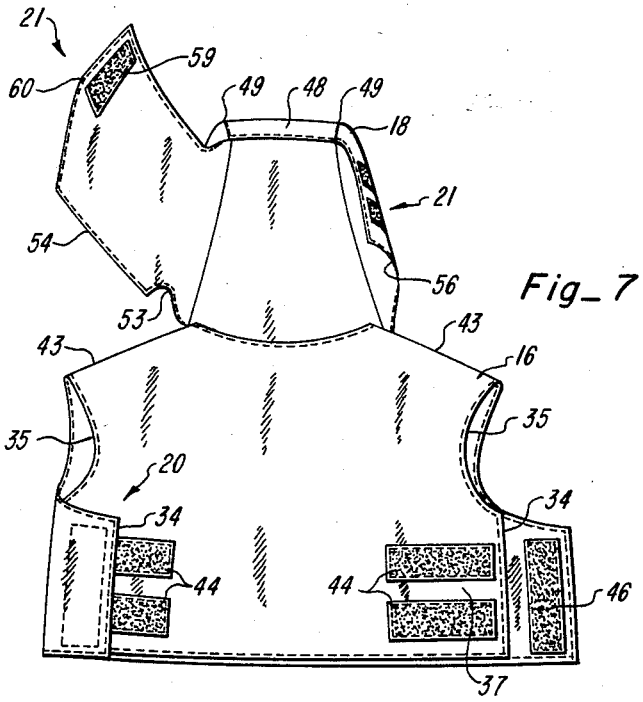

Referring now to the FIGS. 7 through 11, the folding of the vest 15 into the compact storage pack 19 (FIG. 11) will be described. The vest 15 is first laid flat with the back panel 28 of the body portion 16 lying on a flat support surface (not shown). The pads 44 and 46 are fastened to hold the back and front panels 27 and 28 together. The body portion 16 is folded about first vertical folds 69 to a position of slightly less width than the width of the head portion 18 (FIG. 8).

Figure 11:
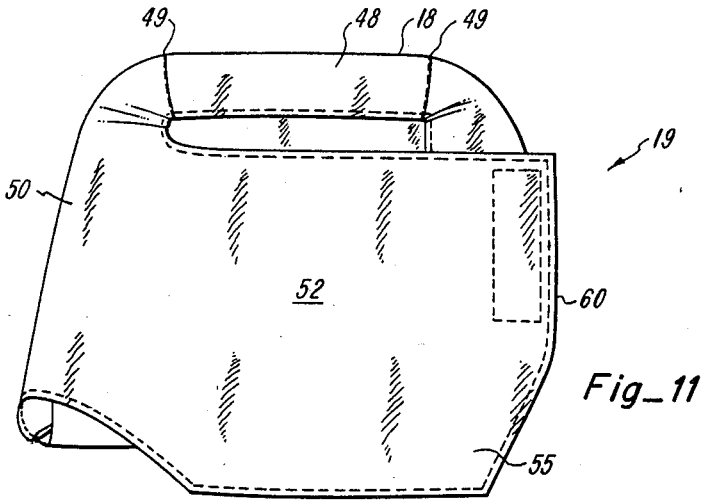
Figure 10:
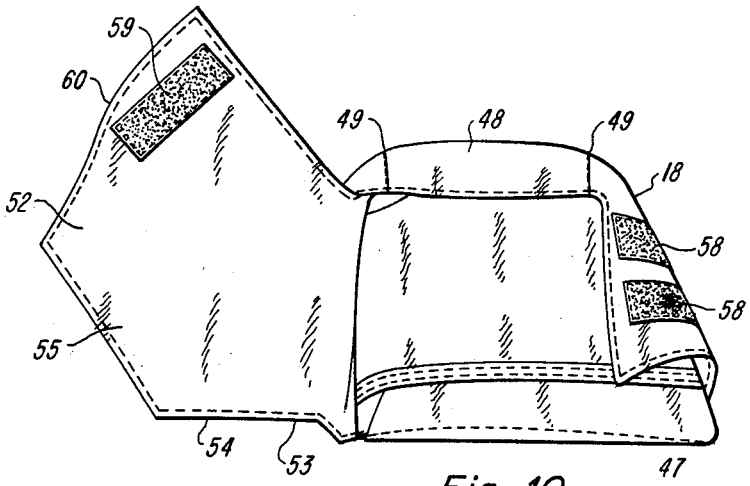
Figure 9:
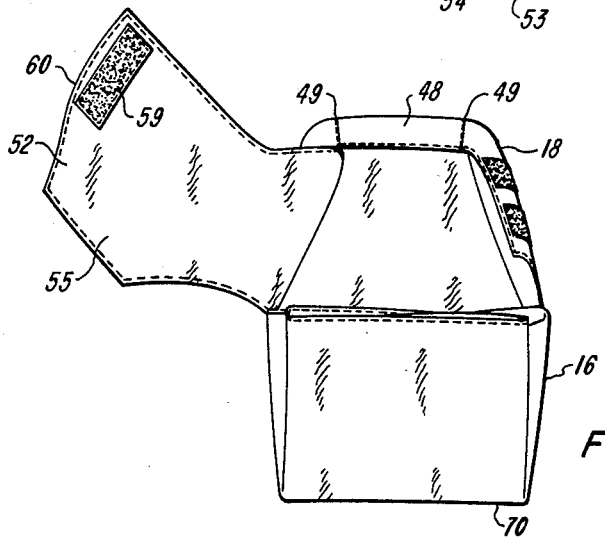

A second horizontal fold 70 wherein the bottom edges 36 and 41 of the body portion 16 are folded to a position generally adjacent to the top edges 32 and 38 is then made (FIG. 9). The thus folded body portion 16 is then inserted into the head portion 18 by folding the body portion about hinge connection 47 (FIG. 10). Lastly, the face panel 52 is pulled across the entire pack and pads 58 and 59 are secured to each other leaving the compact storage pack 19 (FIG. 11).

It should be understood that the just described invention merely illustrates the principles of the invention in selected preferred forms. Many modifications, additions and deletions may vary therefrom without departing from the spirit and scope of the invention as will be set forth in the following claims.

What is claimed is:

1. An aircraft crash protection garment for rapid use and securement about a torso and a head of a wearer in an emergency situation comprising in combination;

a body portion and a head portion, said body and head portions being flexibly interconnected, said body portion having a head opening between front and back panels, said body portion being adapted to be pulled over the head and with the front and back panels receiving the arms of the wearer therebetween and including quick connection means for securing the panels to each other at side edges thereof so that the body portion encompasses the torso of the wearer, said head portion adapted to substantially cover the head of the wearer and having second quick connection means for securing said head portion about the head, said body and head portions manufactured of laminate material providing shock absorption means, puncture resistant means, and thermal protection means.

2. The invention defined in claim 1 wherein said head portion includes a head panel and side panels connected along opposite sides of the head panel, said side panels having a bottom edge substantially mating to the shoulders of the wearer of the body portion, said head portion further having a face panel integrally connected to one of said side panels, said face panel having a neck protector portion adapted to extend downwardly to overlap said body portion.

3. The invention defined in claim 1 wherein said laminate material includes:

an outer layer of inflammable fabric;
a puncture resistant backing layer;
a shock absorption layer; and
a tear resistant inner layer.

4. The invention defined in claim 3 wherein said backing layer has a puncture resistance of approximately two hundred pounds, said shock absorption layer has two layers, one of polyethylene foam and another layer of plastic with large air bubbles formed thereon so as to protrude in a geometric array therefrom, both layers of said shock absorption layer having an energy absorption of between 0.7 and 1.0 inch-pounds per square inch.

5. The invention defined in claim 1 wherein said garment is foldable into a pack wherein said body portion is foldable into said head portion and said second connection means secures said pack.

6. An aircraft crash protection garment for rapid use and securement about a torso and a head of a wearer in an emergency situation comprising in combination:

a body portion having flexibly connected thereto a head portion, said body portion having a front and back panel with a head opening therebetween for rapid use by inserting the wearer's head through the opening and for placement of the wearer's arms between said panels, said front and back panels further having quick connection means for securement about the torso, said head portion substantially covering said head and having second quick connection means for securing said head portion about the head at least said front panel and head portion being made of a laminate material including an outer inflammable layer, a puncture resistant backing layer, a double shock absorption layer including a polyethylene foam layer and a layer of plastic with large air bubbles formed thereon so as to protrude in a geometric array therefrom, and a lightweight tear resistant inner layer that is puncture resistant.

* * * * *